United States Patent [19]

Welsch et al.

[11] Patent Number: 4,601,074

[45] Date of Patent: Jul. 22, 1986

[54] FURNITURE, PARTICULARLY UPHOLSTERED FURNITURE, FOR TRANSFERRING FROM A SITTING POSITION TO A LYING POSITION

[75] Inventors: Bertram Welsch, Coburg; Günther Blauw, Ertingen, both of Fed. Rep. of Germany

[73] Assignees: Alwin Welsch Polstermöbelfabrik KG, Ebersdorf; Erpo Möbelerke W. Blauw GmbH & Co., Ertingen, both of Fed. Rep. of Germany

[21] Appl. No.: 596,280

[22] Filed: Apr. 3, 1984

[30] Foreign Application Priority Data

Apr. 6, 1983 [DE] Fed. Rep. of Germany ..... 3312371

[51] Int. Cl.[4] ..... A47C 17/13; A47C 17/17

[52] U.S. Cl. ..... 5/47; 5/17; 5/37 C; 297/112

[58] Field of Search ..... 5/17, 18 R, 18 B, 44, 5/47, 37 R, 37 B, 37 C; 297/112, 244

[56] References Cited

U.S. PATENT DOCUMENTS

| | | | |
|---|---|---|---|
| 676,004 | 6/1901 | Karpen | 5/37 R |
| 942,723 | 12/1909 | Flindall | 5/37 R |
| 2,170,382 | 8/1939 | Kiesler | 5/37 R |
| 2,770,815 | 11/1956 | Keys | 5/37 R |
| 4,402,096 | 9/1983 | Atimichuk | 5/37 C |

FOREIGN PATENT DOCUMENTS

| | | | |
|---|---|---|---|
| 851672 | 10/1952 | Fed. Rep. of Germany | 5/37 C |
| 866834 | 2/1953 | Fed. Rep. of Germany | 5/37 C |
| 1357523 | 2/1964 | France | 5/37 R |
| 703109 | 1/1954 | United Kingdom | 5/37 C |

*Primary Examiner*—Alexander Grosz
*Attorney, Agent, or Firm*—Max Fogiel

[57] ABSTRACT

Upholstered furniture for transferring a person between a sitting position and a lying position, in which a seating member can be extracted forward out of a stationary base. The seating member has a chassis that is supported so that it can roll. A seating frame is positioned on top and forms a covering. A backrest has two members connected so that they can be swung relative to each other. The rear backrest member is pivoted on the bottom framework, and the front backrest member is connected to the seating frame by catch linkages.

10 Claims, 7 Drawing Figures

A

Figures 1, 2:
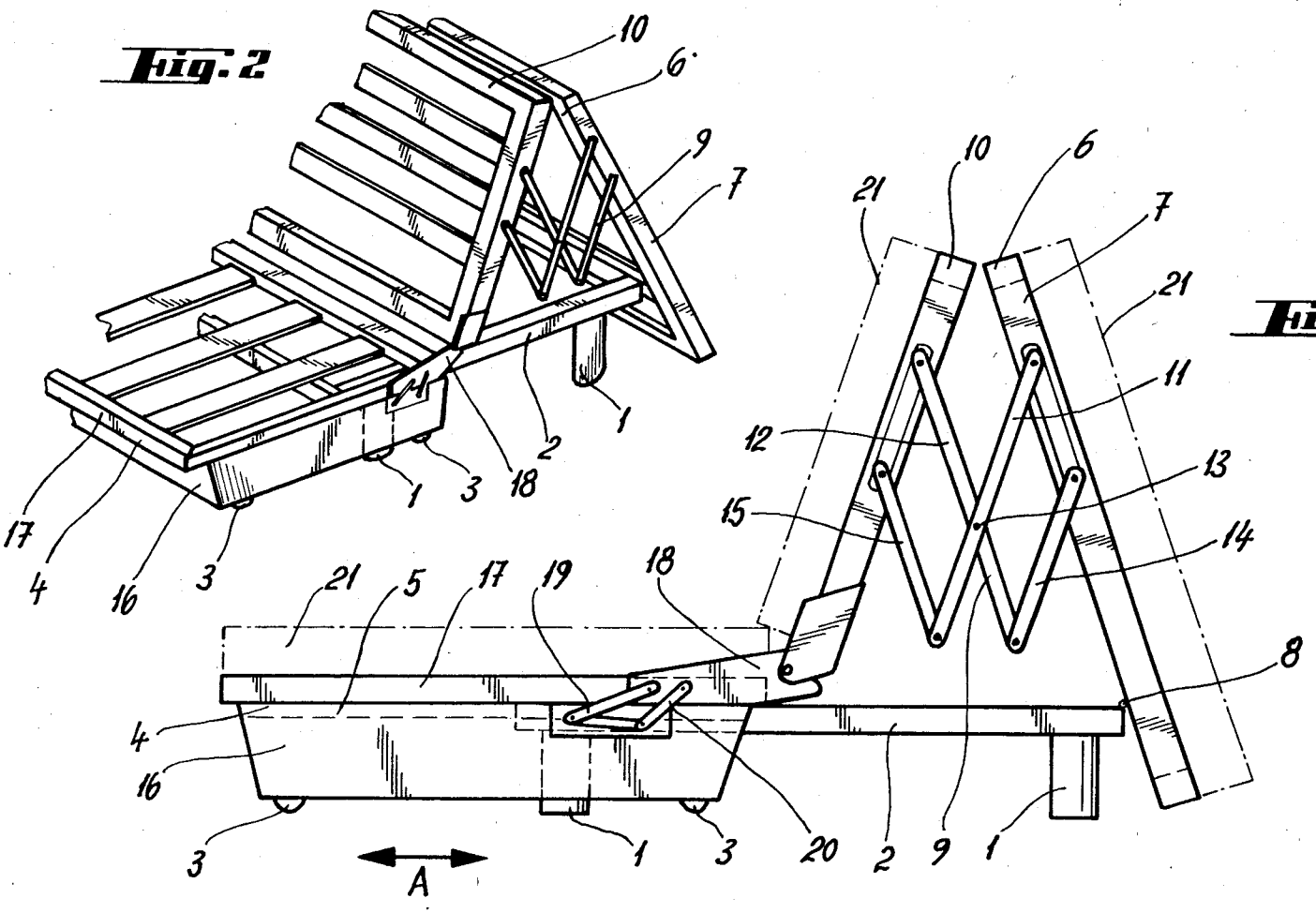

FURNITURE, PARTICULARLY UPHOLSTERED FURNITURE, FOR TRANSFERRING FROM A SITTING POSITION TO A LYING POSITION

The invention concerns furniture, particularly upholstered furniture like an easy chair, sofa, or similar piece, for transferring from a sitting position to a lying position and vice versa with a seating component that can be extracted forward out of a stationary base or bottom framework and that constitutes part of the reclining surface.

Furniture of this type can be utilized on the basis of its potential for convertibility both to sit and to lie on and is enjoying increasing popularity. Especially in second homes or vacation homes, but also in guest rooms or smaller smaller primary residences, this practical furniture are encountered more and more often because, when the seating component is in the inserted state, they represent space-saving seating furniture, although they can on the other hand be converted into reclining furniture that is completely exploitable for resting and sleeping by extracting the seating component.

Known sitting and reclining furniture exhibits, however, generally complicated mechanisms that are employed to convert the furniture from one to the other state of utilization. A considerable expenditure of strength is usually necessary to convert the furniture, which involves tilting or even clamping the mutually disposable and displaceable components. Two people are often needed in order to be able to convert the furniture at all, also necessitating special expertise on the part of the people.

Especially difficult is inserting the seating component because the axes of pivot between the mutually articulated components lie in one plane, so that force of insertion travels through the axes and a dead-point situation occurs.

The object of the present invention is to improve furniture of the type indicated in the preamble to claim 1 to the extent that easy conversion of the furniture from one into another state of utilization is possible with special expertise being required therefor. The mechanism employed is intended to be designed in such a way that it leads to no malfunctions, requires no greater strength, and exhibits long life and long-term utility. The object of the invention consists above all in also providing furniture of the aforesaid type that allows not only comfortable sitting in the sitting position or in one or more intermediate positions but also comfortable rest and sleep in the reclining position and a reclining surface that is long enough.

The body of claim 1 provides characteristics for the design of the invention to attain the object. Practical and advanced developments for attaining the object are claimed in the other claims.

The invention accordingly provides a two-component backrest with its two components articulated together, preferably by means of scissoring linkages positioned on each side. The rear backrest component is attached to the bottom framework in such a way as to pivot on it, whereas the front backrest component is attached to the seating-frame component in such a way as to pivot on it. The seating-frame component constitutes the covering or cover of a bedding box or chassis that is supported in such a way as to roll and can be extracted or inserted out of the stationary bottom framework. The seating-frame component is bracketed to the bedding box or chassis by means of pairs of pivoting brackets in the form of four-bar linkages on both sides. The front backrest component is pivoted to the seating-frame component by means of catch linkages on both sides that allow the seating-frame component to be swung up in one or more defined pivoted positions but catch when the seating-frame component is swung back such that, when the seating-frame component is swung back over the catch linkages, the front backrest component is entrained and swung up. The seating component can accordingly be inserted with no difficulty, whereby the two backrest components fold together and constitute the actual backrest in the sitting position. Once the seating-frame component has been swung up, the bedding box will also be easily accessible, so that bedding etc. can be removed without any problems.

Figure 3:
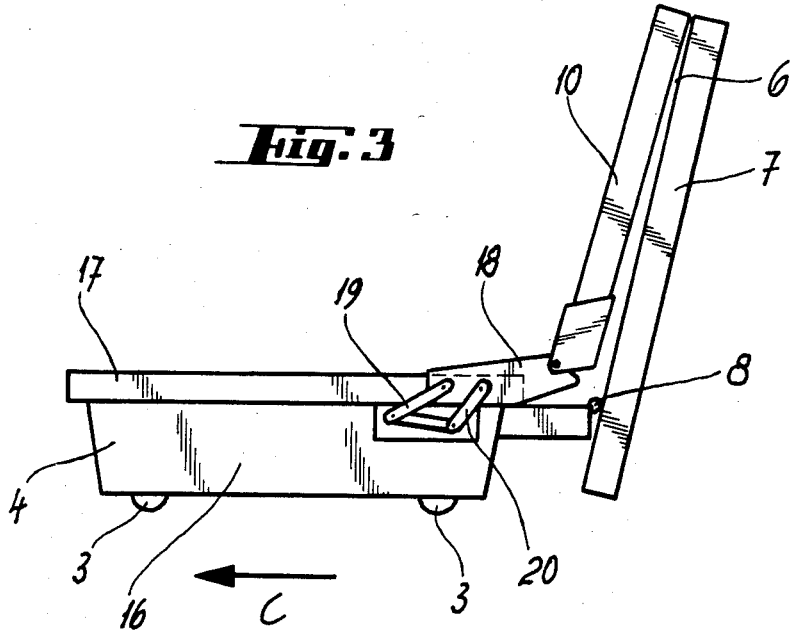
Figure 4:
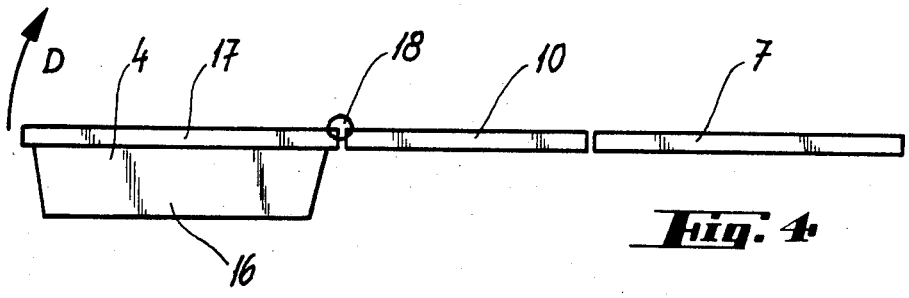
Figure 5:
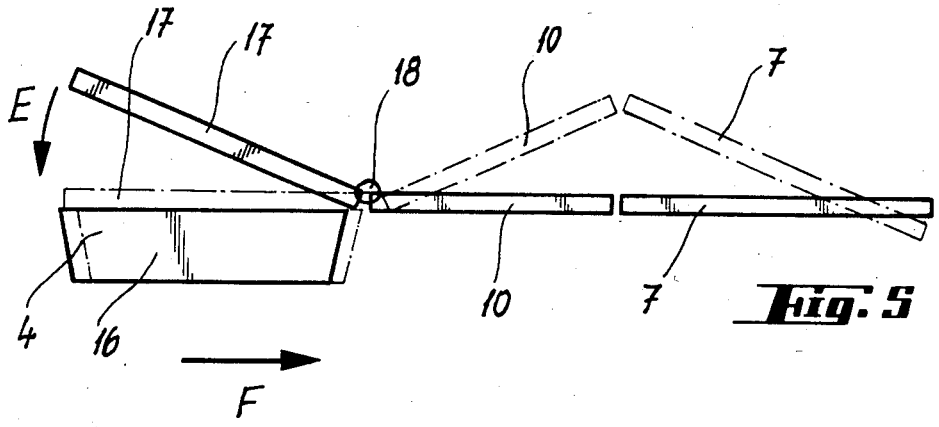
Figure 6:
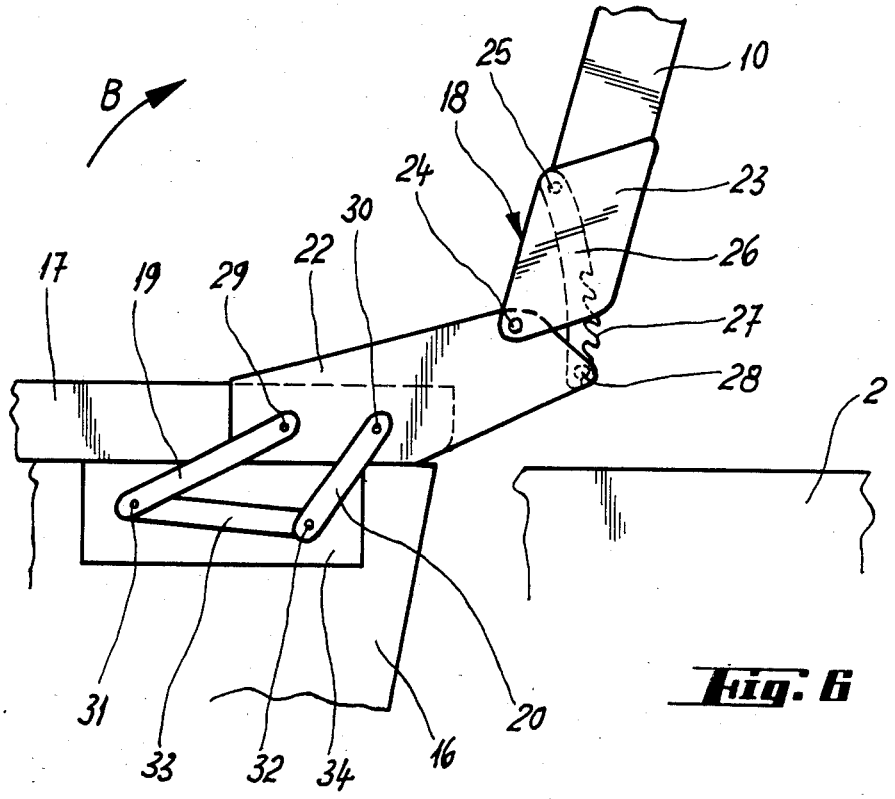
Figure 7:
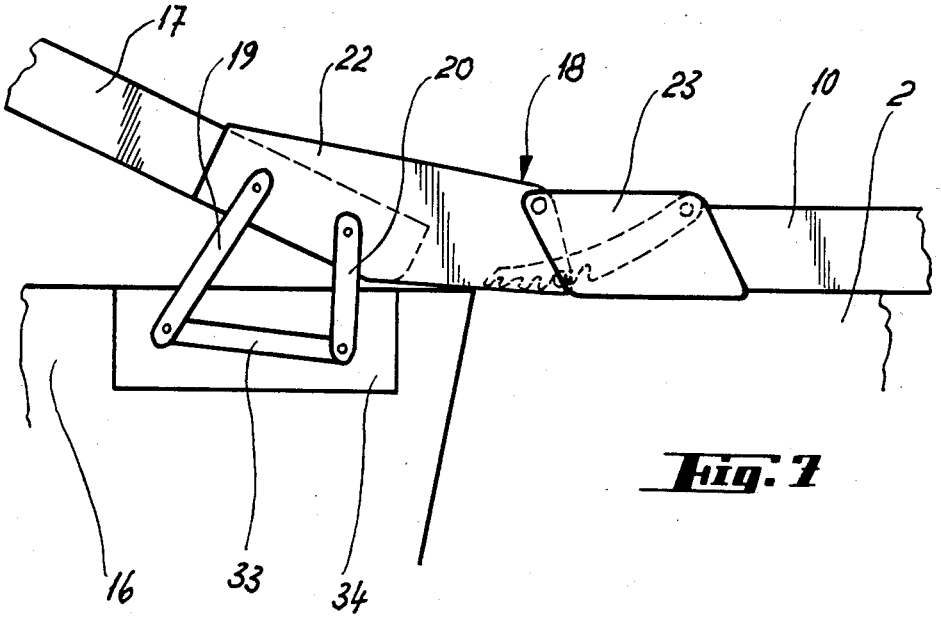

The invention will now be described in relation to one embodiment by way of example and with reference to the drawing. Further advantages and features of the invention will simultaneously become evident. In the drawing, FIG. 1 is a schematic side view of the furniture in and intermediate state corresponding to what is called a relaxation position, FIG. 2 is a smaller-scale schematic perspective view of the furniture in the same position illustrated in FIG. 1, FIG. 3 is a lateral schematic view of the furniture in the sitting position, FIG. 4 is a schematic lateral illustration of the furniture in the reclining position, FIG. 5 is an illustration of the furniture similar to that in FIG. 4 just before or while the sitting component is being inserted, FIG. 6 is a larger-scale lateral illustration of one catch linkage in a position corresponding to that in FIG. 1, and FIG. 7 illustrates the catch linkage in a position corresponding to that in FIG. 5, whereby FIGS. 6 and 7 are each truncated illustrations.

As will be especially evident from FIGS. 1 and 2, the furniture, which is for example of a two-place sofa, consists of a stationary bottom framework 2 supported on the floor on legs 1 and of a rolling seating component 4 supported on castered legs or casters 3 that can be extracted from or inserted into bottom framework 2 in the direction indicated by two-headed arrow A. Seating component 4 is guided in or along bottom framework 2 by the telescoping rails labeled 5.

The furniture has a two-component backrest 6, the rear component 7 of which is hinged to bottom framework 2 (at hinge 8) and is articulated to a front backrest component 10 by means of scissoring linkages 9 on both sides. Each scissoring linkage 9 is more or less in the shape of a four-bar linkage and is symmetrical. Scissoring linkages 9 are each articulated to rear part 7 or to front backrest component 10 by pivoting levers 11 and 12, which are mutually articulated at point 13, whereas the free ends of pivoting levers 11 and 12 are articulated by means of coupling members 14 and 15 to the two backrest components 7 and 10. Scissoring linkages 9 and both backrest components 7 and 10 are designed and positioned such that the upper edges of backrest components 7 and 10 are adjacent and remain so even when both components 7 and 10 are swung. Scissoring linkages 9 accordingly carry out a hinge function.

Seating component 4, which is supported in such a way that it can roll, consists essentially of a chassis or bedding box 16 with casters 3 positioned on its bottom surface and of a seating frame 17 that simultaneously constitutes a covering or cover for bedding box 16. Both seating frame 17 and both backrest components 7 and 10 are in the form of or accommodate a lattice as will be especially evident from FIG. 2. Whereas rear backrest component 7 is, as previously described herein, hinged to bottom framework 2, front backrest component 10 is pivoted to seating frame 17. Specifically, catch linkages 18 that will be specified later herein with reference to FIGS. 6 and 7 are positioned on each side. Seating frame 17 is fastened to bedding box 16 by means of pairs of pivoting brackets 19 and 20, also positioned on each side, which are in the form of four-bar linkages and will also specified later herein with reference to FIGS. 6 and 7.

Cushions 21, represented in FIG. 1 by a dot-and-dash line, are provided on seating frame 17, on front backrest component 10, and on rear backrest component 7. Stops, which are not illustrated, are also positioned on bottom framework 2 and on seating component 4 and enter in sequence into mutual positive contact in such a way as to establish and secure various positions of the furniture, a sitting position and at least one intermediate position called a relaxation position. FIG. 1 illustrates an intermediate position in which the seating component has been extract to a certain extent out of bottom framework 2, whereas the sitting position with seating component 4 complete inserted will be evident from FIG. 3. In the sitting position both backrest components 7 and 10 are erect and positioned more or less back to back. A reclining position in which both backrest components 7 and 10 arrive recumbent one behind the other more or less in the same plane as seating frame 17 is schematically illustrated in FIG. 4. It should be noted that rear backrest component 7 is elongated down and beyond hinge 8 to provided an adequately large reclining surface with large longitudinal dimensions without the seating height in the sitting position or the height of the backrest have to be excessive.

Catch linkages 18 consist, as FIGS. 6 and 7 show, out of the two articulated components 22 and 23 that are articulated together with component 22 rigidly attached to seating frame 17 and articulated component 23 rigidly attached to front backrest component 10. Between articulated components 22 and 23, a denticulated rod 26 with ratchet teeth 27 is articulated at point 25 to articulated component 23. Articulated component 22 supports a pawl bolt 28 that engages between ratchet teeth 27 when articulated components 22 and 23 and hence components 17 and 10 are slipped into position and locked. Denticulated rod 26 is connected to a covering, not illustrated, that releases ratchet teeth 27 only in one direction of pivot as indicated by arrow B in FIG. 6, during, that is, a folding motion in which seating frame 17 is swung toward front backrest component 10, whereas the covering is swung over the teeth in the opposite direction of pivot once seating frame 17 has been completely folded up so that pawl bolt 28 slides along denticulated rod 26.

Seating frame 17, which simultaneously constitutes the cover for bedding box 16 is articulated to bedding box 16 on both sides by means of the pair of pivoting brackets 19 and 20. As will be evident from FIGS. 6 and 7, both pivoting brackets 19 and 20 are positioned in such a way that they incline toward front backrest component 10 in the sitting position. Since the two points 29 and 30 of articulation of pivoting brackets 19 and 20 are closer to each other on seating frame 17 than the two points 31 and 32 of articulation on bedding box 16, the two pivoting brackets 19 and 20 together include an angle that converges upward. It should also be noted that front pivoting bracket 19 is longer than pivoting bracket 20. Since pivoting brackets 19 and 20 are articulated in a practical way directly to the articulated component 22 of catch linkage 18, they constitute in conjunction with the catch linkage a single unit, with another connecting bracket 33 extending between the points 31 and 32 of articulation of pivoting brackets 19 and 20. Connecting bracket 33 is fastened to bedding box 16 by means if necessary of a reinforcement strip 34 attached to bedding box 16. The design of catch linkage 18 and its associated pivoting brackets 19 and 20 as a unit thus extensively establishes all the points of articulation.

The way in which the furniture is operated will now be briefly described.

Extracting seating component 4 forward in the direction indicated by arrow C in FIG. 3 converts the furniture from the sitting position illustrated in FIG. 3 through an intermediate position illustrated in FIG. 1 into the reclining position illustrated in FIG. 4 in which both backrest components 7 and 10 are positioned one after the other in one plane and constitute in conjunction with seating frame 17, which also lies in approximately the same plane, the reclining surface. Backrest components 7 and 10 are almost immediately adjacent to each other and the longer construction of rear backrest component 7 ensures that the reclining surface will be long enough. Swinging seating frame 17 up (arrow D in FIG. 4) makes the inside of bedding box 16 accessible so that bedding etc. can be removed. While seating frame 17 is being swung up, pawl bolt 28 slides along the appropriately slanted ratchet teeth 27. In the upward-swung position of seating frame 17, the not-illustrated covering is displaced over the teeth so that the seating frame can be swung down again directly until it comes to rest on bedding box 16. If, now, the furniture is to be restored from the reclining position to the sitting position, seating frame 17 is lifted only over a specific angle, specifically up to a first catch stage in which pawl bolt 28 falls between two ratchet teeth 27. If seating frame 17 is now swung down out of this position, which is illustrated in FIG. 5, in the direction indicated by arrow E until it arrives in the position indicated by the dot-and-dash lines, front backrest component 10 and hence also rear component 7 will swing over the scissoring linkage, which is not illustrated in this figure, until it assumes the position also indicated by the dot-and-dash line in FIG. 5. Seating frame 17 is simultaneously lifted off of bedding box 16 by pivoting brackets 19 and 20 (cf. FIG. 7). In this position of the individual components in relation to each other, illustrated by the dot-and-dash line in FIG. 5, seating component 4 can be inserted without any difficulty in the direction indicated by arrow F into bottom framework 2, upon which the sitting position or one or more intermediate positions are attained. The intermediate positions and the sitting positions are secured by stops, not illustrated, that can be disengaged by slightly lifting the seating frame.

We claim:

1. Furniture, particularly upholstered furniture, for transferring a person from a sitting position to a lying position and vice versa, comprising: a seating member that can be extracted forward out of a stationary means and forms part of a reclining surface; said seating member comprising a chassis with rolling support means, a seating frame positioned on top of said chassis and forming a covering and a backrest having two backrest members connected so that they can be swung in relation to each other and positioned substantially back-to-back in a sitting position and being positioned one after the other in a reclining position with said seating members extracted; a bottom framework; one of said backrest members being a rear backrest member hinged to said bottom framework; catch linkages on both sides of said seating frame and arranged to catch in one direction of swing; the other one of said backrest members being a front backrest member connected to said seating frame by said catch linkages; said seating frame being pivotally connected to said chassis; scissoring linkage means on both sides of said backrest and comprising a symmetrical double parallelogram connecting said two backrest members; a four-bar linkage connecting said seating frame to said chassis and having pairs of pivoting elements.

2. Furniture as defined in claim 1, including telescoping rails for guiding said seating member on said bottom framework.

3. Furniture as defined in claim 1, including a ratchet rod with ratchet teeth on said catch linkages and being operative when said seating frame and said front backrest member are folded together, said ratchet rod being inoperative when said seating frame and said front backrest member are unfolded out of a folded-up position.

4. Furniture as defined in claim 1, wherein said catch linkages have at least one catch position in which said seating frame when pivoted up is aligned down with respect to said front backrest member and stopped in another direction of swing, said seating frame when pivoted back onto said chassis being lifted by said catch linkages on said front backrest member to the same angle with respect to said bottom framework.

5. Furniture as defined in claim 1, wherein each pair of pivoting elements comprises a longer front bracket and a shorter rear bracket with pivoting points on said seating frame that are closer together than pivoting points of said brackets on said chassis.

6. Furniture as defined in claim 5, wherein said two brackets slope toward said front backrest member in a sitting position and form a converging angle with one another.

7. Furniture as defined in claim 5, wherein said catch linkages have a pivoting member connected to said seating frame, said pivoting brackets pivot on said pivoting member and forming a unit with said catch linkages; and a connecting bracket attachable to said chassis and connected to free ends of said pivoting bracket.

8. Furniture as defined in claim 1, wherein said rear backrest member is connected to said bottom framework by a hinge.

9. Furniture as defined in claim 1, wherein said rear backrest member is elongated downward and to the rear.

10. Furniture, particularly upholstered furniture, for transferring a person from a sitting position to a lying position and vice versa, comprising: a seating member that can be extracted forward out of a stationary means and forms part of a reclining surface; said seating member comprising a chassis with rolling support means, a seating frame positioned on top of said chassis and forming a covering and a backrest having two backrest members connected so that they can be swung in relation to each other and positioned substantially back-to-back in a sitting position and being positioned one after the other in a reclining position with said seating member extracted; a bottom framework; one of said backrest members being a rear backrest member hinged to said bottom framework; catch linkages on both sides of said seating frame and arranged to catch in one direction of swing; the other one of said backrest members being a front backrest member connected to said seating frame by said catch linkages; said seating frame being pivotally connected to said chassis; telescoping rails for guiding said seating member on said bottom framework; a ratchet rod with ratchet teeth on said catch linkages and being operative when said seating frame and said front backrest member are folded together, said ratchet rod being inoperative when said seating frame and said front backrest member are unfolded out of a folded-up position; said catch linkages having at least one catch position in which said seating frame when pivoted up is angled down with respect to said front backrest member and stopped in another direction of swing, said seating frame when pivoted back onto said chassis being lifted by said catch linkages on said front backrest member to the same angle with respect to said bottom framework; each pair of pivoting elements comprising a longer front bracket and a shorter rear bracket with pivoting points on said seating frame that are closer together than pivoting points of said brackets on said chassis; said two brackets sloping toward said front backrest member in a sitting position and forming a converging angle with one another; said catch linkages having a pivoting member connected to said seating frame, said pivoting brackets pivoting on said pivoting member and forming a unit with said catch linkages; a connecting bracket attachable to said chassis and connected to free ends of said pivoting bracket; said rear backrest member being connected to said bottom framework by a hinge; said rear backrest member being elongated downward and to the rear.

* * * * *